US008319407B2

(12) United States Patent
Ke

(10) Patent No.: US 8,319,407 B2
(45) Date of Patent: Nov. 27, 2012

(54) STRAIGHT TUBE LED LAMP HAVING BUCKLE CONNECTING DEVICE FOR SECURING ALL PARTS TOGETHER AS ONE BODY

(75) Inventor: Jianfeng Ke, Zhejiang (CN)

(73) Assignee: Zhejiang Setec Lighting Co., Ltd., Xin Jian Zhuang, Dongguan Town, Shangyu, Zhejiang (CN)

( * ) Notice: Subject to any disclaimer, the term of this patent is extended or adjusted under 35 U.S.C. 154(b) by 95 days.

(21) Appl. No.: 12/745,542

(22) PCT Filed: Dec. 7, 2009

(86) PCT No.: PCT/CN2009/001383

§ 371 (c)(1),
(2), (4) Date: May 29, 2010

(87) PCT Pub. No.: WO2010/130072

PCT Pub. Date: Nov. 18, 2010

(65) Prior Publication Data

US 2011/0074264 A1 Mar. 31, 2011

(30) Foreign Application Priority Data

May 10, 2009 (CN) ..... 2009 2 0119576 U

(51) Int. Cl.
*H01J 7/24* (2006.01)

(52) U.S. Cl. ..... 313/45; 313/46; 257/40; 257/269

(58) Field of Classification Search ..... 313/46; 257/40, 269

See application file for complete search history.

(56) References Cited

U.S. PATENT DOCUMENTS

| | | | | |
|---|---|---|---|---|
| 2004/0179357 | A1* | 9/2004 | Kappe | 362/222 |
| 2007/0241363 | A1* | 10/2007 | Yen | 257/103 |
| 2009/0034269 | A1* | 2/2009 | Li | 362/332 |
| 2009/0295264 | A1* | 12/2009 | Fukui | 313/46 |
| 2010/0008085 | A1* | 1/2010 | Ivey et al. | 362/218 |
| 2010/0079989 | A1* | 4/2010 | Yeh | 362/235 |

FOREIGN PATENT DOCUMENTS

| | | | |
|---|---|---|---|
| CN | 2692477 | Y | 4/2005 |
| CN | 200980183 | Y | 11/2007 |
| CN | 201096278 | Y | 6/2008 |
| CN | 101346022 | A | 1/2009 |
| CN | 101592322 | A | 12/2009 |

* cited by examiner

*Primary Examiner* — Tracie Y Green
(74) *Attorney, Agent, or Firm* — Global IP Services; Tianhua Gu

(57) ABSTRACT

A LED lamp with straight tube comprises a tube body, a lamp cover sheathed at two ends of the tube body and a lamp strip which is in inserted connection in the tube body and comprises a circuit board and a heat diffuser; the lamp cover is internally, fixedly provided with a connecting device connected with the lamp strip; the connecting device comprises a connecting piece on which a connecting arm extending along the length direction of the lamp strip is arranged; the connecting arm is provided with a buckle body; the corresponding position on the surface of the lamp strip is provided with a buckle seat matched with the buckle body; and the circuit board is overlapped and adhered with the radiator to be into a whole through an insulating heat conducting layer.

10 Claims, 6 Drawing Sheets

STRAIGHT TUBE LED LAMP HAVING BUCKLE CONNECTING DEVICE FOR SECURING ALL PARTS TOGETHER AS ONE BODY

CROSS REFERENCE TO RELATED PATENT APPLICATION

The present application is the US national stage of PCT/CN2009/001383 filed on Dec. 7, 2009, which claims the priority of the Chinese patent application No. 200920119576.4 filed on May 10, 2009, which application is incorporated herein by reference.

FIELD OF THE INVENTION

The invention relates to an LED lamp, in particular to an LED straight tube type lamp.

BACKGROUND OF THE INVENTION

The prior LED straight tube type lamp mainly comprises a tube body, a lamp cover arranged on two ends of the tube body and a lamp strip which is arranged in the tube body, wherein the lamp cover and the tube body are adhered generally by adopting chemical adhesives. The adhesives fix the lamp cover on the tube body so that the structure is simple, but the solidification or drying of the adhesives needs certain time, and therefore the product assembly needs longer time. Meanwhile, the adhesives left at gaps between the lamp cover and the tube body are organic chemicals which slowly decompose or dissociate some chemical substances to erode the surface of the tube body of plastic material so as to result in the aging phenomena such as stains, streaks, cracks and the like, so the service life is substantially shortened; furthermore, the chemical adhesives can generate nasty smell, and can harm the operators and generate pollution to the environment during use.

In addition, the lamp strip generally comprises a heat diffuser and a circuit board, wherein the heat diffusion effect of the circuit board is the key technique of making a light emitting dioxide illuminator, and therefore, the techniques of compounding the heat radiator/body with the circuit board/layer through an insulating plate/layer have existed. The most common technique is to make an aluminum-base copper-clad foil laminate into a printed circuit board and then assembling with the heat diffuser through heat conducting silicone grease by using screws.

Undoubtedly, the heat diffusion effect is poor. For example, although all Chinese patents of publication numbers (1) CN201191609Y, (2) CN201110471Y and (3) CN2926814Y have better heat diffusion effect, the main defects of these patents are obvious:

1. poor heat diffusion effect, as the foresaid patents of the publication numbers (1), (2), (3) are provided with uniform insulating layers/plates in between circuit layers/plates and heat diffusion layers/plates, the insulating layers/plates have large heat resistance and low heat transmission efficiency so as to result in poor heat diffusion effect; especially the patent of the publication number (2) adopts the mode of insulating plate assembly, and the heat diffusion effect is worse as gaps exist between relevant components; similarly, the patent of the publication number (3) is further provided with an insulation layer between the circuit board and the heat diffusion body, the heat diffusion body is integrated on a casing, so that the heat diffusion effect is worse.

2. unreasonable structure, all the foresaid three patents are in assembly structure which certainly has influence on the heat diffusion effect; the heat diffusion layer of the foresaid patent of the publication number (1) is a copper-aluminum double-metal composite layer, it is impossible to make absolute seamless connection after all despite of being made by adopting cold rolling pressing technology; as numerous micro-fine depressions exist on the surfaces of the copper plate and the aluminum plate, and the copper plate and the aluminum plate have straightness difference, a large amount of air must be contained between the connection surfaces of the copper plate and the aluminum plate and gas phase heat resistance exists between both, which directly has a strong impact on the heat diffusion effect of the heat diffusion layer.

3. Poor reliability, the insulating layers/plates of the foresaid three patents indefinitely are provided with insulating layers with the flame resistance and the surfaces of the circuit boards are not provided with insulating welding resisting layers, so that it is possible to generate short circuit and trigger fire alarm. And 4. complicated assembly and connection of the circuit layers/board and the LED light emitting dioxide, the foresaid patent of the publication number (1) realizes the electric connection of both through a base plate; and the patent of the publication number (2) realizes the electric connection of both by making the LED light emitting dioxide penetrate out of a through hole of the insulating plate.

SUMMARY OF THE INVENTION

The invention provides a time-saving LED straight tube type lamp with reasonable design, convenient assembly and long service life, which mainly solves the problems of short service life and poisoning of operators caused by the connection of a lamp cover and a lamp tube by using chemical adhesives and environment pollution.

The invention aims at solving the problems of unreasonable structure of a lamp strip of the lamp, poor heat diffusion effect and easy occurrence of short circuit in the prior art, and provides an LED straight tube type lamp with reasonable structure, good heat diffusion effect and safe and reliable use.

The invention adopts the following technical scheme aiming at the technical problems: an LED straight tube type lamp comprises a tube body, a lamp cover sheathed at two ends of the tube body and a lamp strip which is in inserted connection in the tube body and comprises a circuit board and a heat diffuser. The LED straight tube type lamp is characterized in that the lamp cover is internally, fixedly provided with a connecting device connected with the lamp strip; the connecting device comprises a connecting piece on which a connecting arm extending along the length direction of the lamp strip is arranged; the connecting arm is provided with a buckle body, the corresponding position of the surface of the lamp strip is provided with a buckle seat matched with the buckle body; and the circuit board is overlapped and adhered with the heat diffuser to be into a whole through an insulating heat conducting layer.

In the LED straight tube type lamp, the connecting device is adopted to fix the lamp cover and the tube body; the connecting device is fixed in the lamp cover, the buckle body on the connecting arm is buckled in the buckle seat on the surface of the lamp strip when the lamp cover is sheathed at two ends of the tube body, the lamp strip is connected with the internal wall of the tube body through an insertion mode, two ends of the lamp strip prop against the lamp cover, then the lamp strip is fixed and stationary, the lamp cover and the lamp strip are fixed, so that the lamp cover and the tube body are fixed. The said structure design is reasonable, and is simple and time-saving in assembly, the assembly does not need chemical adhesives which can easily erode the tube body, thereby prolonging the service life of the LED tube body and reducing the poisoning of assembly staff and environment pollution. In addition, in the structure of the lamp strip of the invention, the true seamless connection is realized by adopting the insulating heat conducting layer to overlap and adhere the circuit board and the heat diffuser into a whole, the structure is more reasonable and reliable, the heat resistance is small, and the heat conductivity and the flame resistance of an adhering layer is effectively improved with insulating heat conducting material as the adhesives.

As a preferred one of the schemes, the buckle body is a hook body which is arranged at the end part of the connecting arm, the buckle seat is a slotted hole, and the hook body is buckled on the slotted hole. In the scheme, the end part of the connecting arm is provided with the hook body which is in semi arrow shape and is positioned on the lower surface of the connecting arm, the lamp strip is provided with the slotted hole corresponding to the hook body, the hook body and the slotted hole form a buckle structure, which has simple assembly and firm connection.

As a preferred one of the schemes, the buckle body is a protruded column body which is arranged at the end part of the connecting arm or at the position near the end part, the buckle seat is a slotted hole, and the column body is buckled in the slotted hole. In the scheme, the end part of connecting arm or the position near the end part is provided with the column body which is positioned on the lower surface of the connecting arm, the column body can be an entirely uniform cylinder or rectangular column body, or the column body is alternatively a truncated cone or trapezoid column body; the lamp strip is provided with the slotted hole matched with the column body, the slotted hole can be designed into a circular slotted hole or square slotted hole according to the condition of the column body, thus the column body and the slotted hole are in tight fit; and the column body and the slotted hole form a buckle structure, which has simple assembly and firm connection.

As a preferred one of the schemes, the buckle body is a metal sheet which is arranged at the end part of the connecting arm or at the position near the end part, the buckle seat is a magnetic body, and the metal sheet is attached on the magnetic body. In the scheme, the end part of the connecting arm or the lower surface of the position near the end part is provided with the metal sheet, and the lamp strip is provided with the magnetic body corresponding to the metal sheet; the magnetic body can be arranged on the surface of the lamp strip or inserted into the lamp body to play the role of fixing and positioning during replacement; the metal sheet can be provided with a protrusion, and the magnetic body is correspondingly provided with a convex body; and the metal sheet and the magnetic body form a connecting structure, which has simple assembly and firm connection.

As a preferred one of the schemes, the connecting piece comprises a bottom plate and a short side wall arranged along the edge of the bottom plate; the short side wall is C-shaped and attached with the internal wall of the tube body; two ends of the short side wall are respectively provided with a rotation stopper, and a gap is left between the rotation stoppers; the connecting arm is arranged in the gap and connected with the bottom plate; the lamp strip is arranged in a hollow cavity formed by the rotation stoppers and the tube body, the rotation stoppers and the connecting arm are abutted on the surface of the lamp strip, and the shape of the lower part of the heat diffuser coincides with that of the internal surface of the tube body; and the rotation stoppers prevent the rotation of the connecting piece in the lamp cover, so that the connection of the buckle body and the buckle seat is firm.

As a preferred one of the schemes, the heat diffuser is provided with a T-shaped or dovetailed long groove extending along the length direction of the heat diffuser; the internal wall of the tube body is provided with a support which extends along the length direction of the tube body and is matched with the long grove; the long groove is sheathed outside the support; and the heat diffuser is further provided with heat diffusion fins extending along the length direction of the heat diffuser. The long groove of the heat diffuser and the support on the internal wall of the lamp tube are matched to form inserted connection, any end of the lamp strip extends into the tube body when in assembly, the long groove is sheathed on the support and then slides into the lamp tube; and the heat diffusion fins on the heat diffuser play the role of better heat diffusion effect. As a preferred one of the schemes, the insulating heat conducting layer is internally provided with a plurality of glass fiber material layers. The mechanically physical property and the adhesion strength of the insulating heat conducting layers are further improved due to the glass fiber cloth, and the connection of the circuit board and the heat diffuser is more firm and reliable.

As a preferred one of the schemes, the circuit body is a copper foil printed circuit board provided with a plurality of bonding pads which are connected with a light emitting dioxide, so that the assembly and connection of the circuit board and the light emitting dioxide is simple and convenient.

As a preferred one of the schemes, the surface of the circuit board except for the bonding pads is provided with an insulating welding resisting layer which makes the short circuit uneasily occurred.

As a preferred one of the schemes, the lamp tube is a semitransparent or milk-white plastic piece, the lamp tube design is humanized, and light rays emitted are soft so that users feel comfortable.

The invention has the following advantages: 1. simple assembly, time saving and prolonging of the service life of the tube body due to the buckle connection of the lamp cover and the tube body; 2. better heat conductivity and effective improvement of flame resistance as the circuit board and the heat diffuser are adhered through the insulating heat conducting layer; and 3. difficult occurrence of short circuit of the circuit board and safe and reliable use as the circuit board is provided with the insulating welding resisting layer.

DETAIL DESCRIPTION OF THE INVENTION

The technical schemes of the invention are elaborated through embodiments by combining figures.

Figure 1:
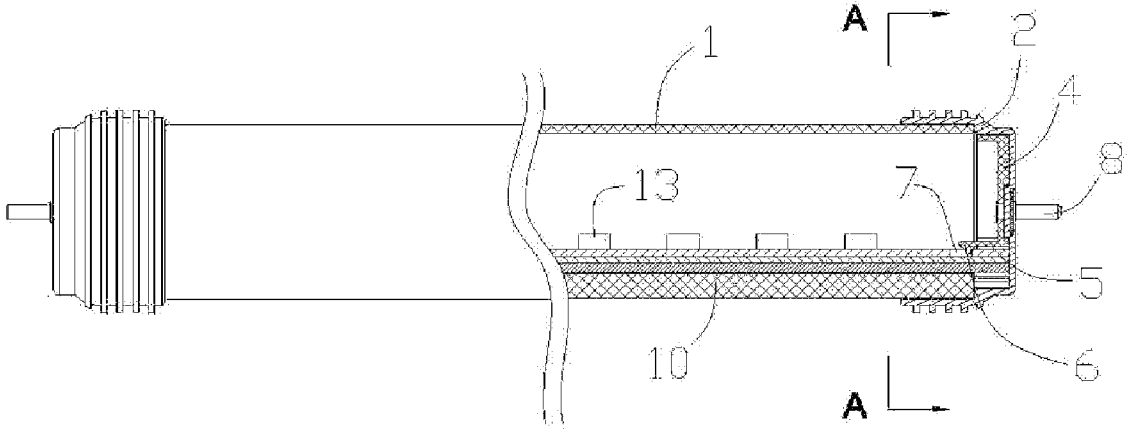
FIG. 1 is a structural schematic drawing of the invention.
Figure 2:
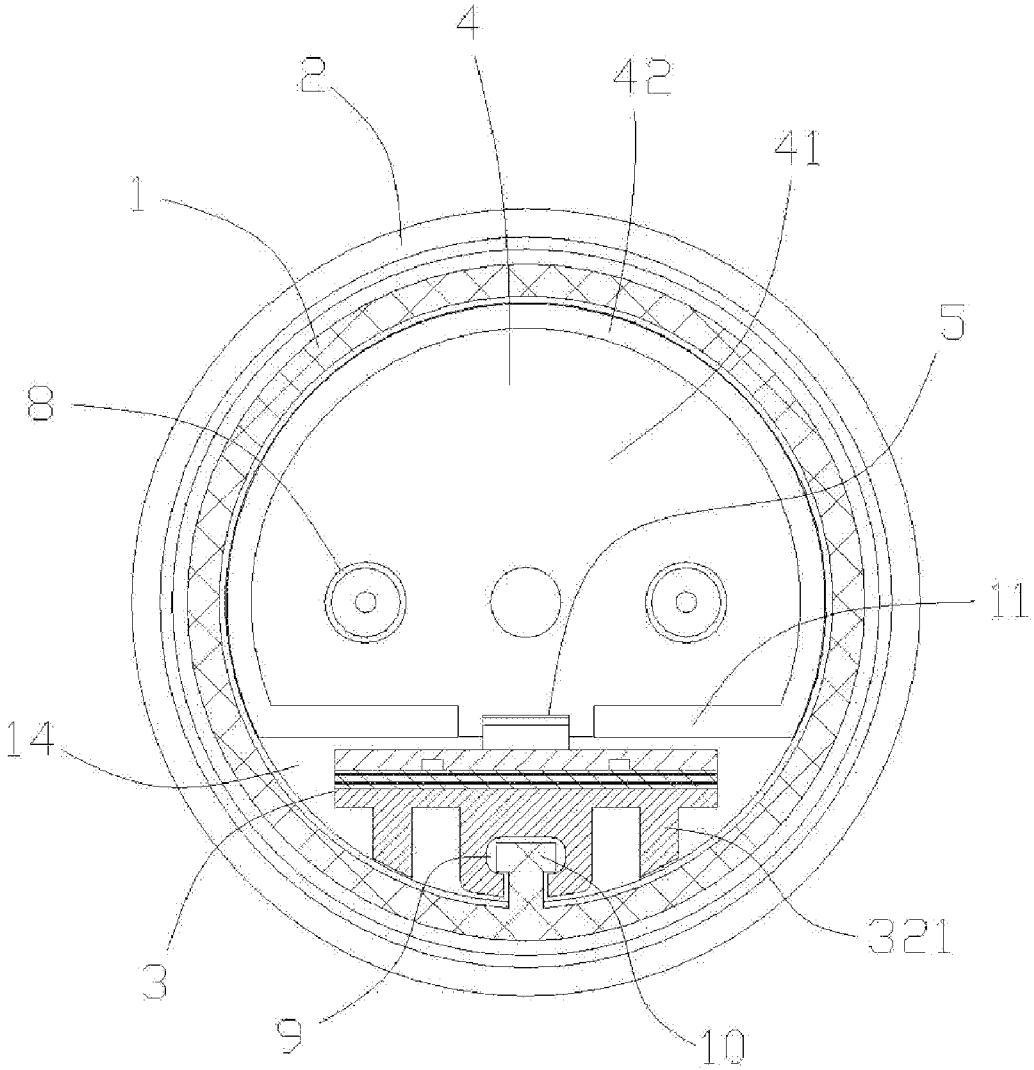
FIG. 2 an A-A section view of FIG. 1.

An LED straight tube lamp of an embodiment as shown in FIGS. 1, 2 comprises a tube body 1 and a lamp strip 3 which is in inserted connection in the tube body; and two ends of the tube body are respectively sheathed with a lamp cover 2 which is fixed on the lamp strip through a connecting device. As shown in FIG. 1, the connecting device comprises a connecting piece 4 which comprises a bottom plate 41 and a short side wall 42 which is arranged along the edge of the bottom plate; the short side wall is C-shaped and attached with the internal wall of the tube body 1; the bottom plate 41 of the connecting piece is in insulated connection with the internal bottom surface of the lamp cover 2 through two lamp pins. The connecting piece is provided with a connecting arm 5 extending along the length direction of the lamp strip; two ends of the short side wall 42 are respectively provided with a rotation stopper 11, and a gap is left between the rotation stoppers 11; the connecting arm is arranged in the gap and connected with the bottom plate; and the connecting arm is provided with a buckle body 6, the corresponding position of the surface of the lamp strip 3 is provided with a buckle seat 7 matched with the buckle body, and the buckle body is buckled on the buckle seat. The lamp strip 3 is arranged in a hollow cavity 14 formed by the rotation stoppers 11 and the tube body 1, the rotation stoppers and the connecting arm are abutted on the surface of the lamp strip, and the shape of the lower part of the heat diffuser 32 coincides with that of the internal surface of the tube body 1, the rotation stoppers and the connecting arm are abutted on the surface of the lamp strip, and the shape of the lower part of the heat diffuser 32 coincides with that of the internal surface of the tube body.

The lower of the buckle seat can be further provided with a release device (not shown in the figure), which mainly comprises an arm body on which a propping body is arranged; the propping body is positioned below the buckle body; the arm body is connected with the connecting piece, and is further connected with an operating body and extends out of the lamp cover, and an operator can prop the buckle body out of the buckle seat through pressing down the operating body. The release device can adopt an alternative scheme, for example, the release device is arranged at the upper part of the buckle body and comprises an arm body; one end of the arm body is connected with the front end of the buckle body and the other end thereof extends out of the lamp cover; the arm body is provided with a fulcrum, the operator can pry the buckle body out of the buckle seat through pressing down the tail end of the arm body.

Figure 6:
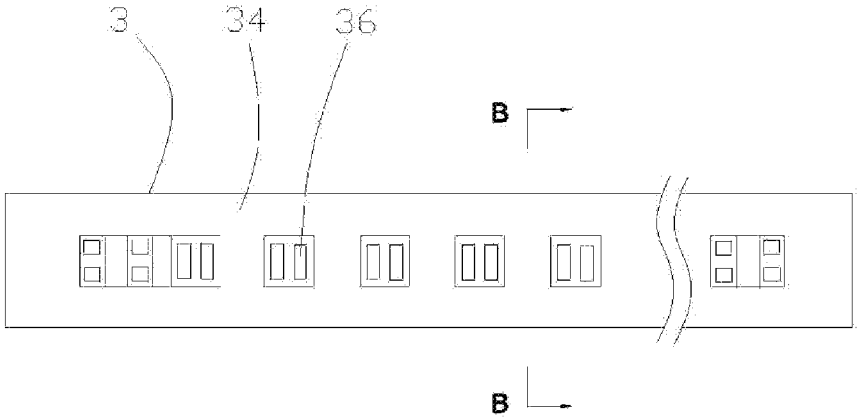
FIG. 6 is a structural schematic drawing of a lamp strip of the invention.
Figure 7:
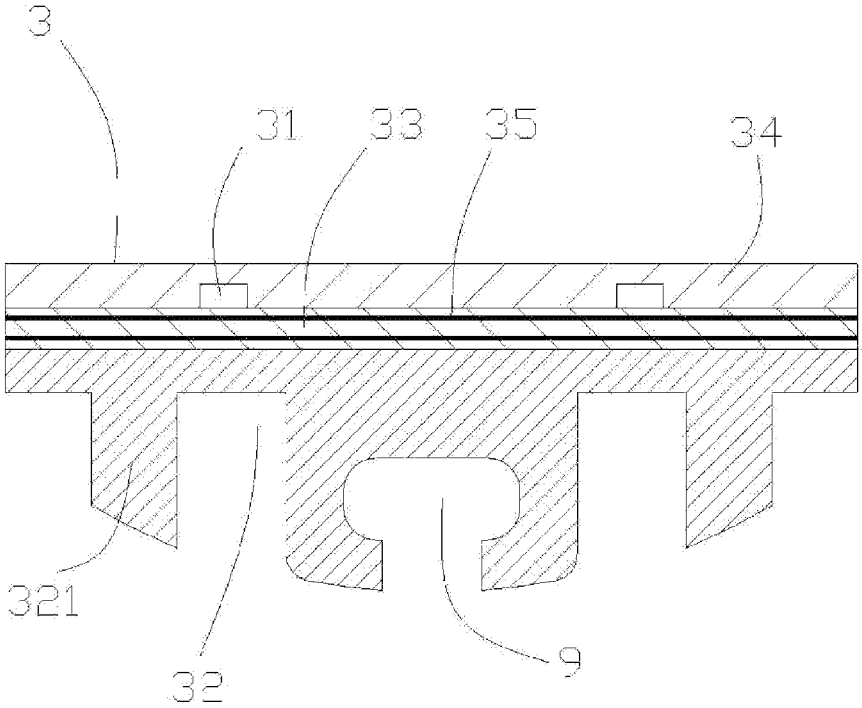
FIG. 7 is a B-B section view of FIG. 6.

As shown in FIGS. 6, 7, a lamp strip 3 comprises a circuit board 31 and a heat diffuser 32; the circuit board is overlapped and adhered with the heat diffuser through an insulating heat conducting layer 33; to enhance the heat conductivity and the flame resistance of the insulating heat conducting layer, the insulating heat conducting layer adopts an insulating heat conducting layer comprising aluminum hydroxide particles which have good flame resistance and good heat conductivity and do not drip and fume under high temperature and insulating epoxy resin. To further improve the mechanically physical property and adhesion strength of the insulating heat conducting layer, the insulating heat conducting layer 33 is further internally provided with a plurality of glass fiber cloth layers 35. But it is not limited to this, aluminum-base or glass fiber base copper-clad foil printed circuit board which is independently produced is adopted to be integrally overlapped and adhered with the heat diffuser. The circuit board of the invention is a copper foil printed circuit board, a copper foil layer which is printed into the surface of the copper foil printed circuit board is provided with a plurality of bonding pads 36 which are respectively conducted with conduction lines printed by the copper foil layer; and as shown in FIG. 1, the bonding pads are used for welding a light emitting dioxide 13, and with the design, the assembly and connection of the light emitting dioxide is convenient. To avoid the short circuit occurred during welding and simultaneously improve the reliability of the circuit board, the surface of the circuit board 31 except for the bonding pads 36 is provided with an insulating welding resisting material layer 34 which can adopt epoxy resin; and the insulating welding resisting layer thoroughly hides the copper foil printed circuit board. As shown in FIG. 6, the heat diffuser 32 is provided with a T-shaped or dovetailed long groove 9 extending along the length direction of the heat diffuser; the internal wall of the tube body 1 is provided with a support 10 which extends along the length direction of the tube body and is matched with the long groove 9 as shown in FIG. 2; and the long groove is sheathed outside the support. And to enhance the heat diffusion effect, the heat diffuser is further provided with heat diffusion fins 321 extending along the length direction of the heat diffuser.

Figure 3:
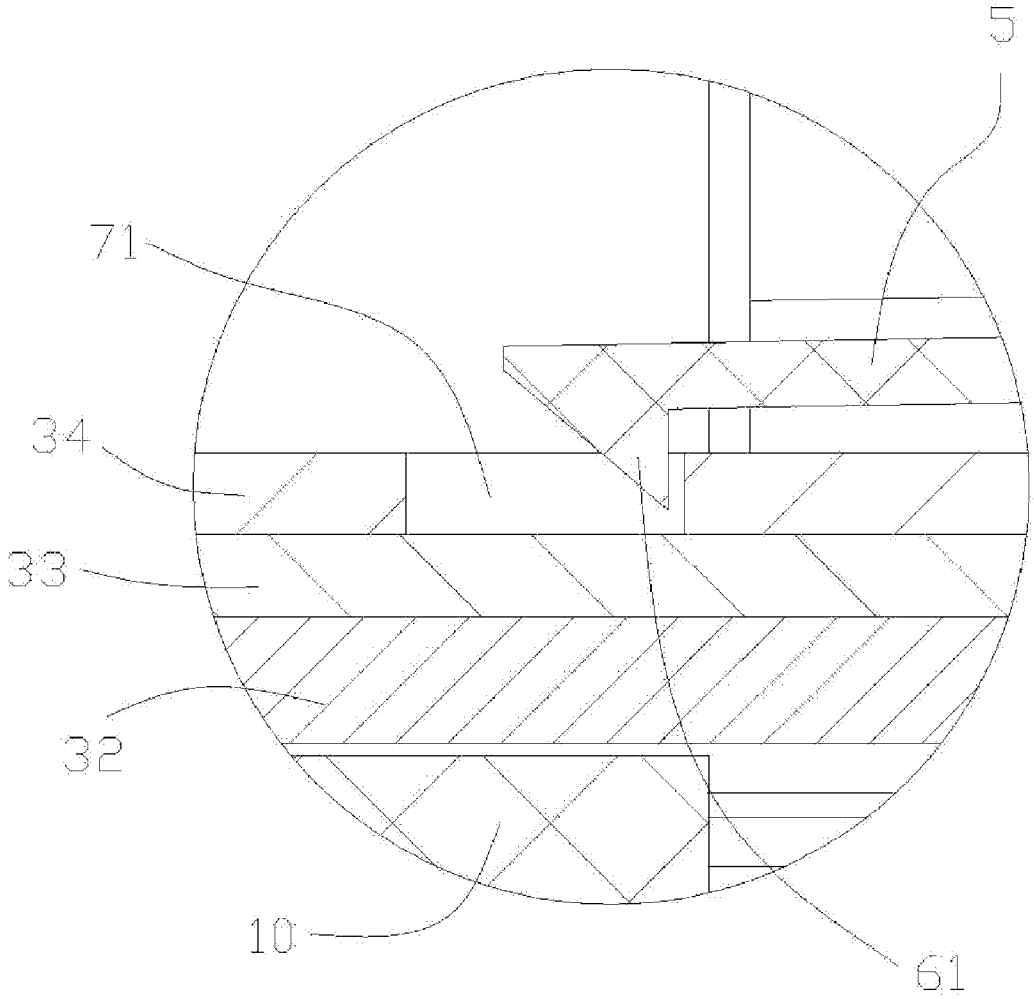
FIG. 3 is a structural schematic drawing of a buckle body and a buckle seat of the invention.

As shown in FIG. 3, a structural scheme of a buckle body 6 and a buckle seat 7 is given. In the scheme, the buckle body is a hook body 61 which is in semi arrow shape and is positioned on the lower surface of the connecting arm, the buckle seat is a slotted hole 71 corresponding to the hook body, and the hook body is buckled in the slotted hole.

Figure 4:
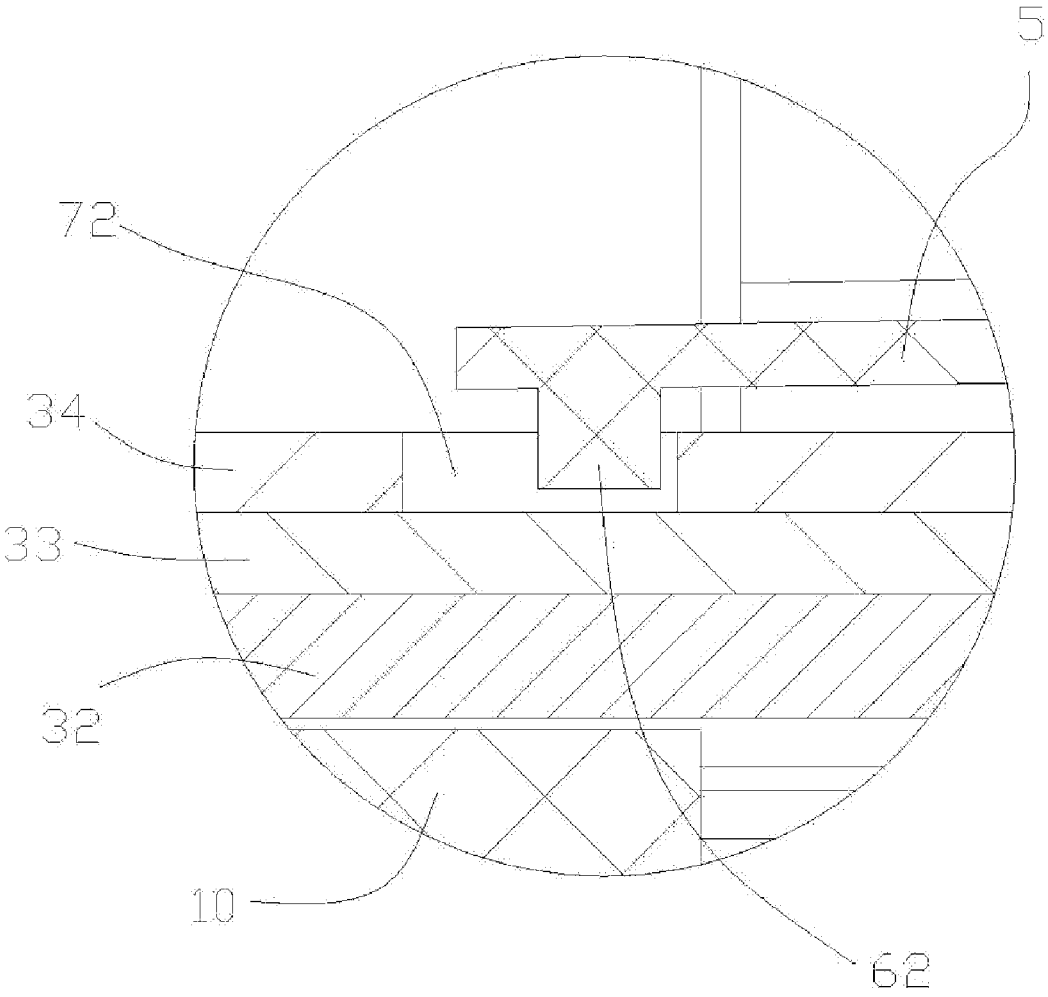
FIG. 4 is a second structural schematic drawing of a buckle body and a buckle seat of the invention.

Another structural scheme of a buckle 6 and a buckle seat 7 is given as shown in FIG. 4. In the scheme, the buckle body is a column body 62 which is positioned on the lower surface of the connecting arm; the column body can be an entirely uniform cylinder or rectangular column body, or the column body can be a truncated cone or a trapezoid column body; the buckle seat is a slotted hole 72 corresponding to the column body; and the slotted hole 72 can be designed into a circular slotted hole or square slotted hole according to the condition of the column body.

Figure 5:
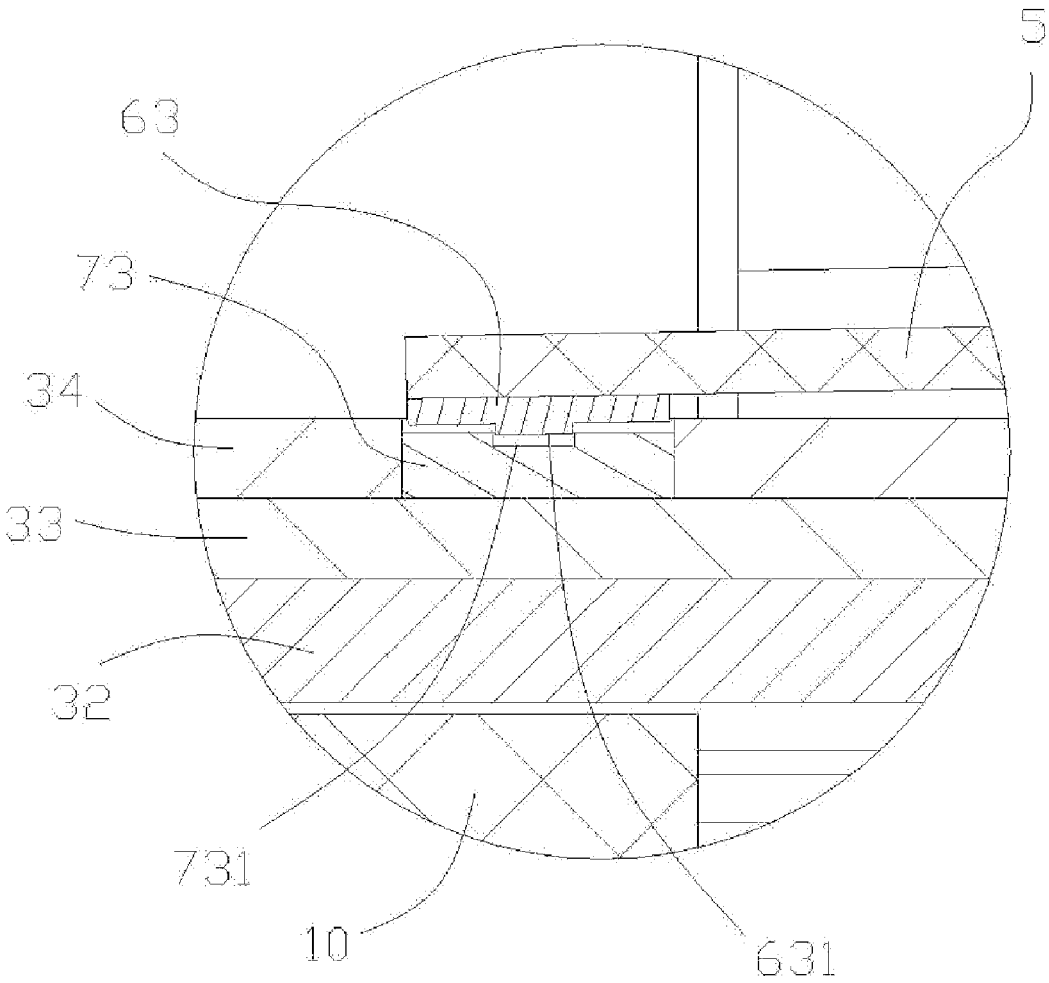
FIG. 5 is a third structural schematic drawing of a buckle body and a buckle seat of the invention.

A third structural scheme of a buckle body 6 and a buckle seat 7 is given as shown in FIG. 5. In the scheme, the buckle body is a metal sheet 63 which is arranged at the end part of the connecting arm or at the position near the end part, the buckle seat is a magnetic body 73 corresponding to the metal sheet, and can be arranged on the surface of the lamp strip or inserted into the lamp tube to play the role of fixing and positioning during replacement; the metal sheet can be provided with a protrusion 631, the magnetic body is correspondingly provided with a convex body 731, and the protrusion is buckled in the convex body when the metal sheet is buckled with the magnetic body.

In the LED straight tube type lamp made by adopting the embodiments, the connection of the lamp cover and the tube body does not need chemical adhesives, and the assembly is convenient and time-saving through the structure of the buckle body and the buckle seat; the lamp strip is produced by adopting seamless hot rolling, so that the LED straight tube type lamp has better heat conductivity and simultaneously has excellent flame resistance and insulativity.

The described embodiments of the invention are barely illustrations of the spirit of the invention. Various modifications to the embodiments of the invention or replacement adopted by similar modes of those described herein will become apparent to those skilled in the art from the foregoing description and teachings, but do not depart from the true scope and spirit of the invention.

Although the invention uses a lot the terms of tube body, lamp cover, lamp strip, heat diffuser, insulating heat conducting layer and the like, but does not exclude the possibility of other terms. These terms barely are used for conveniently describing and interpreting the essence of the invention; and any interpretations to the terms as additional limit of the invention violate the spirit of the invention.

What is claimed is:

1. An LED lamp with straight tube comprising:

a tube body, two lamp covers on two ends of the tube body respectively and a lamp strip inserted in the tube body including a circuit board and a heat radiator;

a connecting device comprising:

a connecting piece (4) fixed on the lamp cover having a connecting arm (5) extending along a length direction of the lamp strip is arranged, a buckle body (6) being provided on the connecting arm, a buckle seat (7) matching with the buckle body positioned on a surface of the lamp strip (3);

the circuit board (31) being adhered with a heat diffuser (32) as a whole body through an electric insulating heat conducting layer (33); and the connecting device tightly connecting the lamp strip (3) with two lamp covers which are on the two ends of the tube body, thereby the lamp covers, tube body, lamp strip and heat diffuser become a one body.

2. The LED lamp with straight tube according to claim 1, wherein the buckle body (6) is a hook body (61), which is arranged at an end part of the connecting arm, the buckle seat (7) is a slotted hole (71), and the hook body is buckled on the slotted hole.

3. The LED lamp with straight tube according to claim 1, wherein the buckle body (6) is a protruded column body (62), which is arranged at an end part of the connecting arm or at a position near the end part, the buckle seat (7) is a slotted hole (72), and the column body (62) is buckled in the slotted hole.

4. The LED lamp with straight tube according to claim 1, wherein the buckle body (6) is a metal sheet (63), which is arranged at an end part of the connecting arm or at a position near the end part, the buckle seat (7) is a magnetic body (73), and the metal sheet is attracted on the magnetic body.

5. The LED lamp with straight tube according to claim 1, wherein the connecting piece (4) comprises a bottom plate (41) and a short side wall (42) arranged along the edge of the bottom plate; the short side wall is C-shaped and attached with the internal wall of the tube body (1); two ends of the short side wall (42) are respectively provided with two rotation stoppers (11), and a gap is between the two rotation stoppers; the connecting arm (5) is arranged in the gap and connected with the bottom plate; the lamp strip (3) is arranged in a hollow cavity (14) formed by the rotation stoppers (11) and the tube body (1); the rotation stoppers and the connecting arm are abutted against the surface of the lamp strip (3); and a shape of lower part of the heat diffuser (32) coincides with that of internal surface of the tube body (1).

6. The LED lamp with straight tube according to claim 1, wherein the heat diffuser (32) is provided with a T-shaped or dovetailed long groove (9) extending along a length direction of the heat diffuser; an internal wall of the tube body (1) is provided with a support (10), which extends along a length direction of the tube body and is matched with the long groove (9); the support (10) is sheathed into the long groove (9), and the heat diffuser is further provided with heat diffusion fins (321) extending along a length direction of the heat diffuser.

7. The LED lamp with straight tube according to claim 1, wherein the electric insulating heat conducting layer (33) is internally provided with a plurality of glass fiber material layers (35).

8. The LED lamp with straight tube according to claim 1, wherein the circuit board (31) is a copper foil printed circuit board provided with a plurality of bonding pads (36) on which a plurality of light emitting diodes are welded.

9. The LED lamp with straight tube according to claim 8, wherein a surface of the circuit board (31) except for the bonding pads (36) are provided with an insulating anti-welding layer (34).

10. The LED lamp with straight tube according to claim 1, wherein the lamp tube (1) is a semitransparent or milk-white plastic tube.

* * * * *